US007715737B2

(12) United States Patent
Yamaura et al.

(10) Patent No.: US 7,715,737 B2
(45) Date of Patent: May 11, 2010

(54) CHARGE ROLL WITH AXIAL END PORTIONS IN CONTACT WITH CLEANING MEMBER AND IMAGE FORMING APPARATUS

(75) Inventors: Masaaki Yamaura, Kanagawa (JP); Yuki Nagamori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 728 days.

(21) Appl. No.: 11/633,010

(22) Filed: Dec. 4, 2006

(65) Prior Publication Data

US 2007/0242964 A1 Oct. 18, 2007

(30) Foreign Application Priority Data

Apr. 18, 2006 (JP) ..... 2006-114372

(51) Int. Cl.
*G03G 15/02* (2006.01)

(52) U.S. Cl. ..... 399/31; 399/24; 399/176

(58) Field of Classification Search ..... 399/24, 399/31, 174, 176
See application file for complete search history.

(56) References Cited

U.S. PATENT DOCUMENTS

| | | | | |
|---|---|---|---|---|
| 7,577,378 | B2 * | 8/2009 | Matsui | 399/115 |
| 2003/0175046 | A1 * | 9/2003 | Namiki et al. | 399/176 |
| 2006/0188293 | A1 * | 8/2006 | Narita et al. | 399/176 |

FOREIGN PATENT DOCUMENTS

| | | |
|---|---|---|
| JP | A-7-128958 | 5/1995 |
| JP | A-7-191525 | 7/1995 |
| JP | A-8-62948 | 3/1996 |
| JP | 09236967 A * | 9/1997 |

* cited by examiner

*Primary Examiner*—David M Gray
*Assistant Examiner*—Barnabas T Fekete
(74) *Attorney, Agent, or Firm*—Morgan, Lewis & Bockius LLP

(57) ABSTRACT

A charge roll disposed in an image forming apparatus, for charging an image carrier for carrying an image, and to be cleaned by a cleaning member, the charge roll including: a shaft and an electrically conductive layer provided around the shaft, an axial end portion of the electrically conductive layer in an area in contact with the cleaning member being formed into skin layer portions thinner than other portions of the electrically conductive layer, is provided.

15 Claims, 12 Drawing Sheets

Ini

500kcycle

1Mcycle

FIG.10

| THICKNESS OF CHARGE ROLL SURFACE LAYER (μm) | THICKNESS OF SKIN LAYER PORTION (μm) | PROPORTION OF THICKNESS OF SKIN LAYER PORTION | DEFECTIVE CHARGING IN INITIAL STAGE | PROBLEM OF EARLIER EXPOSURE OF RUBBER LAYER OTHER THAN SKIN LAYER PORTIONS |
|---|---|---|---|---|
| 10 | 4 | 40% | × | ○ |
| 10 | 4.5 | 45% | × | ○ |
| 10 | 5 | 50% | ○ | ○ |
| 10 | 6 | 60% | ○ | ○ |
| 10 | 7 | 70% | ○ | ○ |
| 10 | 8 | 80% | ○ | ○ |
| 10 | 9 | 90% | ○ | ○ |
| 10 | 9.5 | 95% | ○ | × |
| 20 | 8 | 40% | × | ○ |
| 20 | 9 | 45% | × | ○ |
| 20 | 10 | 50% | ○ | ○ |
| 20 | 12 | 60% | ○ | ○ |
| 20 | 14 | 70% | ○ | ○ |
| 20 | 16 | 80% | ○ | ○ |
| 20 | 18 | 90% | ○ | ○ |
| 20 | 19 | 95% | ○ | ○ |

FIG.12

| | SURFACE REFLECTIVITY OF OUTERMOST SURFACE LAYER (%) | | | |
|---|---|---|---|---|
| SURFACE REFLECTIVITY OF RUBBER LAYER (%) | 80 | 60 | 40 | 20 |
| 80 | × | ○ | ○ | △ |
| 60 | ○ | × | ○ | ○ |
| 40 | ○ | ○ | × | ○ |
| 20 | ○○ | ○ | ○ | × |

○○:STABLY DETECTABLE
○:DETECTABLE
△:LIFE DETECTION IS ADVANCED
×:CHANGE CANNOT BE DETECTED

CHARGE ROLL WITH AXIAL END PORTIONS IN CONTACT WITH CLEANING MEMBER AND IMAGE FORMING APPARATUS

BACKGROUND

1. Technical Field

The present invention relates to an image forming apparatus such as an electrophotographic copier or printer and particularly to an image forming apparatus including a charge roll for charging a surface of an image carrier driven for rotation and a cleaning member for this charge roll.

2. Related Art

In a charging device of a contact charge type, a charge roll is always in contact with or extremely close to an image carrier and therefore a surface of the charge roll is likely to get dirty due to adhesion of foreign matters. Although the surface of the image carrier repeatedly carrying out image forming operation enters an area for a charging process after going through a cleaning process for removing foreign matters such as residual toner after the transfer on a downstream side of a transfer process, particles smaller than the toner, such as a part of the toner or an additive of the toner or the like, remain on the image carried without being cleaned even after the cleaning process and adhere to the surface of the charge roll. The foreign matters that has adhered to the surface of the charge roll causes nonuniformity in surface resistance of the charge roll, which causes abnormal discharge or unstable discharge to thereby deteriorate charge uniformity.

SUMMARY

According to an aspect of the present invention, there is provided: a charge roll disposed in an image forming apparatus, for charging an image carrier for carrying an image, and to be cleaned by a cleaning member, the charge roll including: a shaft and an electrically conductive layer provided around the shaft, an axial end portion of the electrically conductive layer in an area in contact with the cleaning member being formed into skin layer portions thinner than other portions of the electrically conductive layer.

BRIEF DESCRIPTION OF THE DRAWINGS

Exemplary embodiments of the present invention will be described in detail based on the following figures, wherein:

FIG. 10 is a table showing a result of examination of the change in defective charging when a proportion between thicknesses of a skin layer portion and an outermost surface layer is changed.

FIG. 11 B is a graph showing examination of fluctuations in output voltage during the life detection according to difference in surface roughness of the rubber layer and the outermost surface layer.

FIG. 12 is a graph showing examination of the accuracy of the life detection of according to the difference in surface reflectivity of the rubber layer and the outermost surface layer.

DETAILED DESCRIPTION

Exemplary embodiments of an image forming apparatus of the present invention will be described below based on the drawings.

Figure 1:
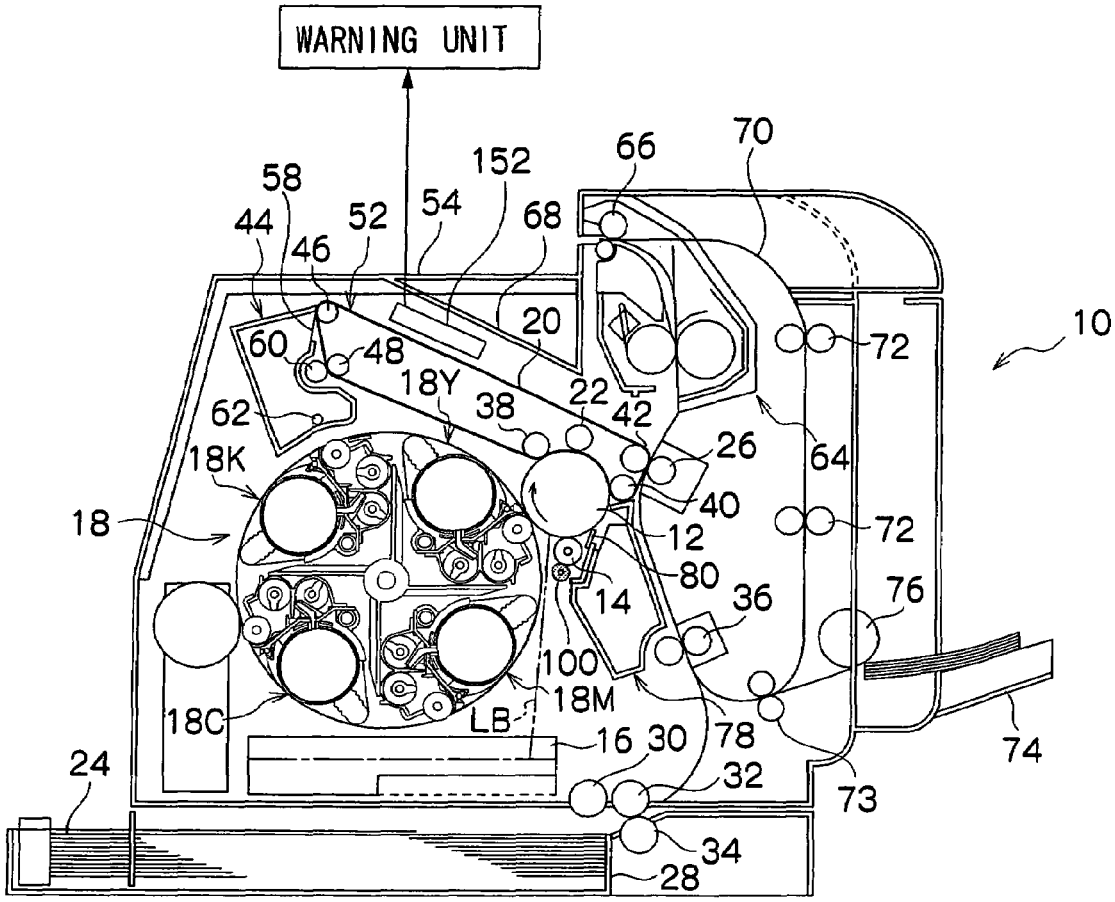
FIG. 1 is a schematic configurational view showing an image forming apparatus according to a first embodiment of the present invention.

FIG. 1 shows a four-cycle full-color image forming apparatus 10 according to the first embodiment. In the image forming apparatus 10, a photosensitive drum 12 is rotatably disposed at a position slightly upper right from the center portion thereof. As this photosensitive drum 12, a conductive cylinder member having a surface covered with a photosensitive layer made of OPC or the like and a diameter of about 47 mm is used, for example. The photosensitive drum 12 is driven for rotation at a processing speed of about 150 mm/sec along a direction of an arrow by a motor (not shown).

The surface of the photosensitive drum 12 is charged to a predetermined potential by a charge roll 14 disposed substantially right under the photosensitive drum 12 and then subjected to an image exposure by a laser beam LB with an exposure device 16 disposed below the charge roll 14, such that an electrostatic latent image according to image information is formed on the surface.

The electrostatic latent image formed on the photosensitive drum 12 is developed by a rotary developing device 18 in which developing units 18Y, 18M, 18C, and 18K of respective colors of yellow (Y), magenta (M), cyan (C), and black (K) are arranged along a circumferential direction, and turns into a toner image with predetermined colors.

At this time, the surface of the photosensitive drum 12 is repeatedly subjected to respective processes of charging, exposing, and developing a predetermined number of times according to colors of an image to be formed. In the developing process, the rotary developing device 18 rotates and the developing units 18Y, 18M, 18C, or 18K corresponding to the colors move to developing positions facing the photosensitive drum 12.

In forming a full-color image, for example, the respective processes of charging, exposing, and developing are repeated four times corresponding to the respective colors of yellow (Y), magenta (M), cyan (C), and black (K) on the surface of the photosensitive drum 12, and toner images corresponding to the respective colors of yellow (Y), magenta (M), cyan (C), and black (K) are formed sequentially on the surface of the photosensitive drum 12. In forming the toner images, the number of times the photosensitive drum 12 rotates is different depending on the size of an image. However, in case of an A4-size image, one image is formed by three rotations of the photosensitive drum 12. In other words, the toner images corresponding to the respective colors of yellow (Y), magenta (M), cyan (C), and black (K) are formed on the surface of the photosensitive drum 12 each time the photosensitive drum 12 rotates three times.

The toner images of the respective colors of yellow (Y), magenta (M), cyan (C), and black (K) sequentially formed on the photosensitive drum 12 are transferred by a primary transfer roll 22 at a primary transfer position where an intermediate transfer belt 20 is wound around an outer periphery of the photosensitive drum 12 such that the toner images overlap each other on the intermediate transfer belt 20.

The toner images of yellow (Y), magenta (M), cyan (C), and black (K) transferred onto the intermediate transfer belt 20 in a superimposed state are transferred by one operation by a secondary transfer roll 26 onto sheets of recording paper 24 fed at a predetermined timing.

On the other hand, sheets of recording paper 24 are sent out by a pickup roll 30 from a paper feed cassette 28 disposed at a lower portion of the image forming apparatus 10, fed one by one and separately from each other by a feed roll 32 and a retard roll 34, and conveyed by resist rolls 36 to a secondary transfer position of the intermediate transfer belt 20 in synchronization with the toner images which have been transferred onto the intermediate transfer belt 20.

The intermediate transfer belt 20 is stretched under a predetermined tension by a wrap-in roll 38 for specifying a wrapped position of the intermediate transfer belt 20 on an upstream side of the photosensitive drum 12 in a rotating direction, a primary transfer roll 22 for transferring the toner images formed on the photosensitive drum 12 onto the intermediate transfer belt 20, a wrap-out roll 40 for specifying a wrapped position of the intermediate transfer belt 20 on a downstream side of the wrapped position, a backup roll 42 in contact with the secondary transfer roll 26 via the intermediate transfer belt 20, a first cleaning backup roll 46 facing a cleaning device 44 of the intermediate transfer belt 20, and a second cleaning backup roll 48. The intermediate transfer belt 20 is driven by the rotation of, for example, the photosensitive drum 12 so as to cyclically move at a predetermined process speed (about 150 mm/sec).

Here, the intermediate transfer belt 20 is formed such that a cross sectional shape of the stretched intermediate transfer belt 20 is substantially a flat, elongated trapezoid in order to miniaturize the image forming apparatus 10.

The intermediate transfer belt 20 constitutes an image forming unit 52 integrally with the photosensitive drum 12, the charge roll 14, the intermediate transfer belt 20, the plurality of rolls 22, 38, 40, 42, 46, and 48 for stretching the intermediate transfer belt 20, the cleaning device 44 for the intermediate transfer belt 20, and a cleaning device 78 for the photosensitive drum 12 which is to be described later. Therefore, by opening an upper cover 54 of the image forming apparatus 10 and lifting up a grip (not shown) provided on an upper portion of the image forming unit 52 by hand, the overall image forming unit 52 can be removed from the image forming apparatus 10.

On the other hand, the cleaning device 44 of the intermediate transfer belt 20 includes a scraper 58 disposed to be abutted against a surface of the intermediate transfer belt 20 stretched out by the first cleaning backup roll 46 and a cleaning brush 60 disposed to be pressed against the surface of the intermediate transfer belt 20 stretched out by the second cleaning backup roll 48. Residual toner, paper powder, and the like which have been removed by the scraper 58 and the cleaning brush 60 are collected into the cleaning device 44.

The cleaning device 44 is disposed so as to be able to swing circumferentially counterclockwise in the drawing about a swing shaft 62. The cleaning device 44 moves away and stays at a position spaced apart from the surface of the intermediate transfer belt 20 until the secondary transfer of the toner image of the last color finishes, and abuts against the surface of the intermediate transfer belt 20 when the secondary transfer of the toner image of the last color has finished.

Moreover, the sheet of recording paper 24 onto which the toner images have been transferred from the intermediate transfer belt 20 is conveyed to a fixing device 64. Then, the toner images are heated and pressed by the fixing device 64 and fixed onto the sheet of recording paper 24. Then, in case of single-sided printing, the sheets of recording paper 24 onto which the toner images have been fixed are discharged onto a discharge tray 68 provided on an upper portion of the image forming apparatus 10 by discharge rolls 66.

On the other hand, in case of double-sided printing, the sheet of recording paper 24 onto a first surface (front surface) of which the toner images have been fixed by the fixing device 64 is not discharged onto the discharge tray 68 by the discharge rolls 66. While a rear end portion of the sheet of recording paper 24 is held by the discharge rolls 66, the discharge rolls 66 are rotated reversely, a conveying path of the sheet of recording paper 24 is switched to a paper conveying path 70 for the double-sided printing, and the sheet of recording paper 24 is reversed by conveying rolls 72 disposed on the paper conveying path 70 for the double-sided printing. In this state, the sheet of recording paper 24 is carried to the secondary transfer position of the intermediate transfer belt 20 again and the toner images are transferred onto a second surface (backside surface) of the sheet of recording paper 24. Then, the toner images on the second surface (backside surface) of the sheet of recording paper 24 are fixed by the fixing device 64 and the sheet of recording medium 24 is discharged onto the discharge tray 68.

Furthermore, a manual insertion tray 74 can be mounted optionally to a side face of the image forming apparatus 10 in such a manner that the tray 74 can be opened and closed. Sheets of recording paper 24 with arbitrary size and type placed on the manual insertion tray 74 are fed by a paper feed roll 76 and conveyed to the secondary transfer position of the intermediate transfer belt 20 via conveying rolls 73 and the resist rolls 36. In this way, it is possible to form an image on sheets of recording paper 24 with the arbitrary size and type.

After the transfer process of the toner images has finished, the residual toner, paper powder, and the like on the surface of the photosensitive drum 12 are removed by a cleaning blade 80 of the cleaning device 78 disposed obliquely below the photosensitive drum 12 each time the photosensitive drum 12 rotates once to prepare the photosensitive drum 12 for the next image forming process.

Figure 2:
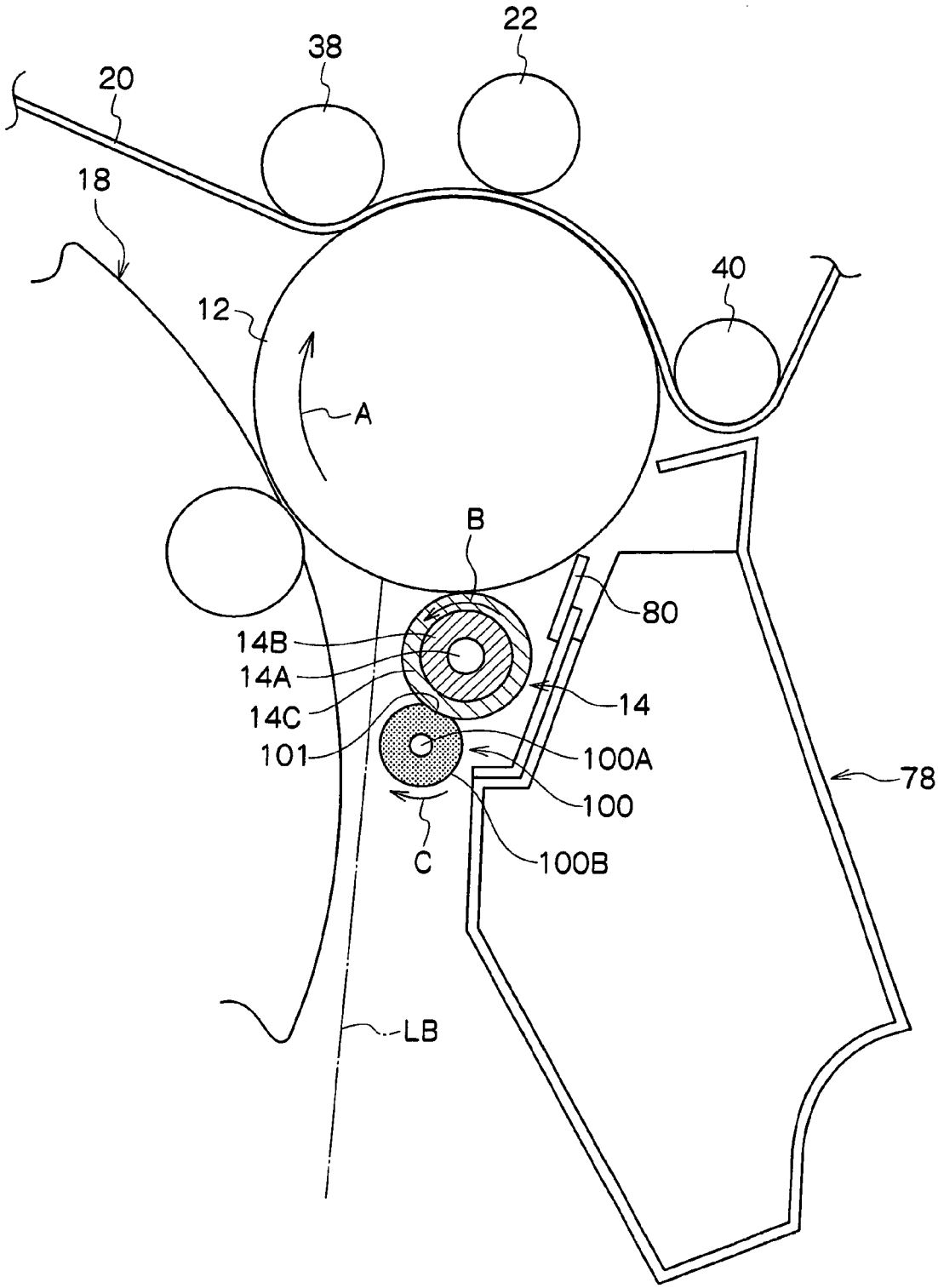
FIG. 2 is an enlarged view of a configuration surrounding a charge roll and a cleaning roll used in the image forming apparatus according to the first embodiment of the present invention.

As shown in FIG. 2, the charge roll 14 is disposed under the photosensitive drum 12 so as to be in contact with the photosensitive drum 12. The charge roll 14 is composed of a rubber layer 14B formed around an electrically conductive shaft 14A and an outermost surface layer 14C, and the shaft 14A is rotatably supported. The rubber layer 14B and the outermost surface layer 14C are made of semiconductive materials as described later. In a position below the charge roll 14 on the side thereof opposite to the photosensitive drum 12, a roll-shaped cleaning roll 100 in contact with the surface of the charge roll 14 is provided. The cleaning roll 100 is composed of a sponge layer 100B formed around a shaft 100A, and the shaft 100A is rotatably supported.

The cleaning roll 100 is pressed under a predetermined load against the charge roll 14, and the sponge layer 100B is elastically deformed along a peripheral surface of the charge roll 14 to form a nip portion 101. The photosensitive drum 12 is driven for clockwise rotation (in the direction of the arrow A) in FIG. 2 by a motor (not shown) and the charge roll 14 is rotated in the direction of the arrow B by the rotation of the photosensitive drum 12. The roll-shaped cleaning roll 100 is rotated in the direction of the arrow C by the rotation of the charge roll 14.

As the cleaning roll 100 is rotated, dirt such as the toner, an external additive agent, or the like on the surface of the charge roll 14 is cleaned by the cleaning roll 100. The charge roll 14 and the cleaning roll 100 have physical properties of scraping the surface of the charge roll 14 as the cleaning roll 100 comes in contact therewith. Such physical properties can be obtained by adjusting the material, a surface microhardness, and a modulus of elasticity of the charge roll 14 and adjusting material, the number of cells of foam, and an amount of engagement in the charge roll 14 of the cleaning roll 100. These physical properties will be described later.

Next, the cleaning roll 100 will be described.

As the material of the shaft 100A of the cleaning roll 100, a free-cutting steel, a stainless steel, or the like are used. The proper material and the surface treatment method are selected according to the purpose of use such as a sliding property. A material without conductivity may be subjected to a general treatment such as a plating treatment so as to make the material conductive or may be used as it is of course. Moreover, since the cleaning roll 100 comes in contact with the charge roll 14 via the sponge layer 100B at a proper nip pressure, a material having such strength as not to flex in nipping or a shaft diameter having sufficient rigidity with respect to a shaft length is selected.

The sponge layer 100B is formed of porous foam having a three-dimensional structure. The material of the sponge layer 100B is selected from foamable resins or rubbers such as polyurethane, polyethylene, polyamide, olefin, melamine, or polypropylene, NBR, EPDM, natural rubber, and styrene-butadiene rubber, chloroprene, silicon, and nitrile. As the sponge layer 100B, polyurethane, which is resistant against tearing, pulling, and the like, is used especially preferably so as to efficiently clean foreign matter such as the external additive agent from the rotation of the charge roll 14 while sliding thereon as well as to prevent the scratch by the sponge layer 100B from being generated on the surface of the charge roll 14 and prevent the sponge layer 100B from being broken for a long period of time.

Polyurethane is not especially limited. It is only essential that the material involves a reaction between polyol such as polyester polyol, polyether polyester, acrylic polyol, and the like and isocyanate such as 2,4-tolylene diisocyanate, 2,6-tolylene diisocyanate, 4,4-diphenylmethane diisocyanate, tolidine diisocyanate, and 1,6-hexamethylene diisocyanate and it is preferable that a chain extension agent such as 1,4-butanediol and trimethylolpropane is mixed into the material. It is common practice to carry out foaming by using a foaming agent such as water and an azo compound, e.g., azodicarbonamide or azobisisobutyronitrile. Moreover, auxiliary agents such as a foaming aid, a foam adjuster, and a catalyst may be added as necessary.

Stable cleaning performance is considered to be maintained over a long term by taking the foreign matters such as the external additive agent and toner adhering to the charge roll 14 into the cells of the foam of the cleaning roll 100, returning the foreign matter that has been collected and coagulated to a proper size in the cells from the cleaning roll 100 to the photosensitive drum 12 via the charge roll 14, and collecting the foreign matter into the cleaning device 78 for cleaning the photosensitive drum 12.

For this purpose, the number of cells of the cleaning roll 100 is preferably 40 to 80/25 mm and much preferably 45 to 75/25 mm. By setting the number of cells as such value, it becomes easy to take the foreign matter such as the external additive agent into the cells and to transfer the taken-in foreign matters such as the external additive agent to the charge roll 14 and the photosensitive drum 12. If the number of the cells is greater than 80/25 mm, the performance of taking in the external additive agent reduces due to small cell diameters. If the number of cells is smaller than 40/25 mm instead, the cell diameters become excessively large and it becomes difficult to coagulate the taken-in external additive agent to a proper size to be transferred to the charge roll 14.

A diameter of the cleaning roll 100 is $\phi$ 8 mm to $\phi$ 15 mm and preferably $\phi$ 9 mm to $\phi$ 14 mm and a wall thickness of the sponge layer 100B is preferably 2 mm to 4 mm. If the diameter is 15 mm or more, the number of times each position of the peripheral surface of the cleaning roll 100 comes into contact with the external additive agent reduces and the number of cleanings reduces, which is excellent in stability of the cleaning performance over a long term but is disadvantageous in terms of miniaturization. The diameter 9 mm or less is advantageous because the image forming apparatus can be miniaturized but is disadvantageous in stability over a long term because the number of times each position of the peripheral surface comes into contact with the external additive agent increases and the number of cleanings increases.

The amount of engagement of the cleaning roll 100 in the charge roll 14 is preferably 10% to 60% and much preferably 20% to 50% of the wall thickness of the sponge layer 100B. By setting the amount of engagement in such a range, it is possible to obtain proper nip width and nip pressure and it becomes easy to minutely scrape the surface of the charge roll 14. If the amount of engagement is smaller than 10%, the nip width and nip pressure are insufficient and it is impossible to minutely scrape the charge roll 14. If the amount of engagement is greater than 60%, it is impossible to stably bring the cleaning roll 100 in pressure contact with the charge roll 14 and it is impossible to uniformly scrape the surface of the charge roll 14.

It is preferable that the sponge layer 100B includes abrasive particles formed of the external additive agent added to the toner, for example. As the abrasive particles, $SeO_2$ or the like is used. By including such abrasive particles, it becomes easy for the cleaning roll 100 to minutely scrape the surface of the charge roll 14.

Next, the charge roll 14 will be described.

The charge roll 14 has a two-layer structure, including the semiconductive rubber layer 14B on the conductive shaft 14A, and the outermost surface layer 14C formed of a semiconductive layer on the rubber layer 14B. The rubber layer 14B is formed by mixing conductive powder such as carbon black and metal oxides. As the outermost surface layer 14C, nylon resin, acrylic resin, and the like are used.

The surface microhardness of the outermost surface layer 14C of the charge roll 14 is preferably 0.03 or higher and 2.0 or lower and much preferably 0.05 or higher and 0.3 or lower. Here, the surface microhardness is a physical property value obtained by measuring the hardness of several μm of a surface layer and is affected by change of surface layer material of the charge roll 14.

The surface microhardness is not obtained by obtaining a length of a diagonal line of an indent as the Vickers hardness that is widely used for measuring hardness of metal material, but can be obtained by measuring an amount of entry of an indenter into a test sample. If a test load is represented by P (mN) and an entry amount of the indenter into the test sample (indentation depth) is represented by D (μm), the surface microhardness DH is defined by the following expression (1).

$$DH=\alpha P/D2 \qquad \text{Expression (1)}$$

where α is a constant based on the shape of the indenter and α=3.8584 (when a triangular pyramid indenter is used).

The surface microhardness is a hardness obtained from the load applied when the indenter is pressed in and the indentation depth and expresses a strength property of the material in a state including not only plastic deformation but also elastic deformation of the test sample. Moreover, the measured area is minute and it is possible to measure the hardness more precisely in a range close to a toner particle diameter.

The surface microhardness of the outermost surface layer 14C of the charge roll 14 is measured by using an ultra micro hardness tester DUH-201 S (manufactured by Shimadzu Corporation). Measurement conditions are as follows.

Measurement environment: 23° C., 55% RH

Used indenter: a triangular indenter

Test mode: 3 (soft material test)

Test load: 0.70 gf

Load speed: 0.0145 gf/sec

Retention time: 5 sec

By setting the surface microhardness of the outermost surface layer 14C of the charge roll 14 in the above range, the cleaning roll 100 can minutely scrape the peripheral face of the outermost surface layer 14C of the charge roll 14 when the cleaning roll 100 is brought into contact with the charge roll 14. If the surface microhardness is 0.05 or less, the surface of the charge roll 14 is scraped excessively to cause uneven wear. If the surface microhardness is 0.3 or more, the amount that the cleaning roll 100 minutely scrapes the surface of the charge roll 14 reduces slightly.

A diameter of the charge roll 14 is preferably ϕ8 mm to ϕ15 mm and much preferably ϕ 9 mm to ϕ 14 mm, and a wall thickness of the outermost surface layer 14C is preferably 2 mm to 4 mm. If the diameter is 15 mm or more, the number of times each position of the peripheral face comes into contact with the external additive agent reduces and the number of discharges reduces, which is excellent in stability against dirt and of charging performance over a long term but is disadvantageous in terms of miniaturization. The diameter 8 mm or less is advantageous because the image forming apparatus 10 can be miniaturized but is disadvantageous in stability over a long term because the number of times each position of the peripheral surface comes into contact with the external additive agent increases and the number of discharges increases.

A modulus of elasticity of the outermost surface layer 14C of the charge roll 14 is preferably 8 MPa or greater and 4500 MPa or smaller and is much preferably 10 MPa or greater and 3000 MPa or smaller. If the modulus of elasticity is smaller than 8 MPa, a stable nip shape is not formed by the press of the cleaning roll 100 and it is impossible to minutely scrape the surface of the charge roll 14. On the other hand, if the modulus of elasticity is greater than 4500 MPa, the charge roll 14 is deformed significantly at the nip portion 101 with the cleaning roll 100 such that the cleaning performance is caused to reduce and the defective charging is generated because the nip shape with the photosensitive drum 12 becomes uneven. Here, the modulus of elasticity is a value measured by a rheometer manufactured by Leometrix company and a parallel plate marketed under a trade name of "RDA2" (RHIOS system ver.4.3) and having a diameter of 8 mm, at a plate interval of 4 mm, at a frequency of 1 rad/sec, at a temperature rising speed of 1° C./min, at a measurement temperature in a range of 40 to 150° C., and under an automatic distortion control of 20% at the maximum. It is needless to say that the charge roll 14 is not limited to the following structure as long as the charge roll 14 has the predetermined electrifying performance.

As the material of the shaft 14A, a free-cutting steel, a stainless steel, or the like is used. The proper material and surface treatment method are selected according to the purpose of use such as sliding property on a bearing, for example. A material without conductivity may be subjected to a general treatment such as plating so as to make the material conductive.

The semiconductive elastic layers that constitutes the rubber layer 14B and the outermost surface layer 14C of the charge roll 14 may be formed by adding an elastic material such as rubber with elasticity, an electrically conductive agent such as carbon black, an ion conduction agent for regulating the resistance value of the conductive elastic layers, and materials normally possible to be added to rubber, e.g., a softener, a plasticizer, a hardener, a vulcanizing agent, a vulcanization accelerator, an antioxidant, and fillers such as silica, calcium carbonate, and the like, as necessary. The charge roll 14 is formed by coating the peripheral surface of the conductive shaft 14A with the mixture obtained by adding the materials which are normally added to rubber. As the electrically conductive agent for regulating the resistance value, materials dispersed to conduct electricity by using electrons and/or ions as charge carriers, such as carbon black or an ion conductive agent mixed into matrix material, can be used. The elastic material may be foam.

The elastic material forming the electrically conductive layer is formed by dispersing the electrically conductive agent in a rubber material, for example. As the rubber material, there are isoprene rubber, chloroprene rubber, epichlorohydrin rubber, butyl rubber, urethane rubber, silicon rubber, fluororubber, styrene-butadiene rubber, butadiene rubber, nitrile rubber, ethylene propylene rubber, epichlorohydrin-ethyleneoxide copolymer rubber, epichlorohydrin-ethyleneoxide-allyl glycidyl ether copolymer rubber, ethylene-propylene-diene terpolymer rubber (EPDM), acrylonitrile-butadiene copolymer rubber, natural rubber, and the like and blended rubber of them. Among them, silicon rubber, ethylene propylene rubber, epichlorohydrin-ethyleneoxide copolymer rubber, epichlorohydrin-ethyleneoxide-allyl glycidyl ether copolymer rubber, acrylonitrile-butadiene copolymer rubber, and blended rubber of them are used preferably. These rubber materials may be foamed or non-foamed materials.

As the conductive agent, an electronic conductive agent or an ionic conductive agent is used. Examples of the electronic conductive agent are fine powders of: carbon black such as Ketjen black and acetylene black; pyrolytic carbon, graphite; various conductive metals or alloys such as aluminum, copper, nickel, and stainless steel; various electrically conductive metal oxides such as tin oxide, indium oxide, titanium oxide, tin oxide-antimony oxide solid solution, and tin oxide-indium oxide solid solution; insulating material with its surface subjected to a conducting treatment. Examples of the ion conductive agent are: perchlorate, chlorate, and the like such as tetraethylammonium, lauryl trimethylammonium, and the like; and perchlorate, chlorate, and the like of alkali metal and alkaline earth metal, such as lithium, magnesium, and the like.

These conductive agents may be used individually or two or more of them can be used in combination. The additive amount of the electrically conductive agents is not especially limited but the additive amount of the electric conductive agent described above is preferably in a range of 1 to 60 pts.mass of 100 pts.mass of rubber materials. On the other hand, the additive amount of the ion conductive agent is preferably in a range of 0.1 to 5.0 pts.mass of 100 pts.mass of rubber material.

The outermost surface layer 14C is formed for preventing pollution by the foreign matters such as toner. The material of the outermost surface layer may be either of resin and rubber and is not especially limited. Examples of the material are polyester, polyimide, copolymer nylon, silicon resin, acrylic resin, polyvinyl butyral, ethylene-tetrafluoroethylene copolymer, melamine resin, fluororubber, epoxy resin, polycarbonate, polyvinyl alcohol, cellulose, polyvinylidene chloride, polyvinyl chloride, polyethylene, ethylene-vinyl acetate copolymer, and the like.

Among them, polyvinylidene fluoride, tetrafluoroethylene copolymer, polyester, polyimide, and copolymer nylon are used preferably from the viewpoint of the external additive agent dirt. The copolymer nylon includes one or a plurality of 610 nylon, 11 nylon, and 12 nylon as a polymerized unit. As other polymerized units included in the copolymer, there are 6 nylon, 66 nylon, and the like. Here, a percentage of the polymerized units formed of 610 nylon, 11 nylon, and 12 nylon that included in the copolymer is preferably 10% by weight or higher in total. If the percentage of the polymerized unit is 10% or higher, an excellent property of liquid preparation and an excellent film forming property in application of the surface layer can be obtained, wear of a resin layer and adhesion of the foreign matters to the resin layer especially when used repeatedly are suppressed, excellent durability of the roll is obtained, and change of the properties due to environment is suppressed.

The above high polymer materials may be used individually or two or more of them may be used in combination. The number average molecular weight of the high polymer materials is preferably in a range of 1,000 to 100,000 and much preferably in a range of 10,000 to 50,000.

The outermost surface layer may include electrically conductive material to regulate the resistance. As the electrically conductive material, the material having a particle diameter of 3 μm or smaller is desirable. As the electrically conductive agent for the purpose of regulating the resistance value, the materials dispersed to conduct electricity by using electrons and/or ions as charge carriers, such as carbon black or conductive metal oxide particles mixed into the matrix material or ion conductive agent, can be used.

Concrete examples of the carbon black as the conductive agent are "Special black 350" manufactured by Degussa, "Special black 100" manufactured by the same, "Special black 250" manufactured by the same, "Special black 5" manufactured by the same, "Special black 4" manufactured by the same, "Special black 4A" manufactured by the same, "Special black 550" manufactured by the same, "Special black 6" manufactured by the same, "Color black FW200" manufactured by the same, "Color black FW2" manufactured by the same, "Color black FW2V" manufactured by the same, "MONARCH 1000" manufactured by Cabot Corporation, "MONARCH 1300" manufactured by Cabot Corporation, "MONARCH 1400" manufactured by Cabot Corporation, "MOGUL-L" manufactured by the same, "REGAL 400R" manufactured by the same, and the like.

The carbon blacks have pH of 4.0 or smaller and have better dispersibility into a resin composition than general carbon blacks due to the effect of an oxygen-containing functional group existing on a surface. By mixing the carbon black having the pH 4.0 or less, it is possible to improve charging uniformity and to reduce fluctuations of the resistance value.

The above conductive metal oxide particles which are conductive particles for regulating the resistance value may be particles of any of tin oxide, antimony-doped tin oxide, zinc oxide, anatase type titanium oxide, ITO, and the like, and are not especially limited as long as the particles have electrical conductivity and are electrically conductive agent using electrons as charge carriers. They can be used individually or two or more of them can be used together. The particles may have any diameters as long as the diameters do not hinder the present invention. However, from the view point of the regulation of the resistance value and strength, the particles are preferably tin oxide, antimony-doped tin oxide, anatase type titanium oxide and much preferably tin oxide and antimony-doped tin oxide.

By controlling the resistance with such conductive materials, the resistance value of the outermost surface layer does not change due to environmental conditions and stable characteristics thereof can be obtained. Moreover, fluororesin or silicon resin is used to the outermost surface layer. The layer is especially preferably formed of fluorine modified acrylate polymer. Moreover, fine particles may be added into the outermost surface layer. In this way, the outermost surface layer becomes hydrophobic to thereby prevent adhesion of the foreign matters to the charge roll 14. Furthermore, it is also possible to add insulating particles such as alumina and silica to form protrusions and depressions on the surface of the charge roll 14 such that the load in sliding on and scrubbing of the photosensitive drum 12 is reduced to thereby enhance mutual wear resistance between the charge roll 14 and the photosensitive drum 12.

Next, skin layer portions 151 of the charge roll 14 will be described.

As shown in FIGS. 3A to 3D, the charge roll 14 is arranged to be in contact with the cleaning roll 100. The charge roll 14 has the skin layer portions 151 at its axial end portion. Under the skin layer portions 151, protrusions 150 are formed by protrusion of the rubber layer 14B as the second layer as shown in a section A-A'. On the other hand, portions other than the skin layer portions 151, neither the outermost surface layer 14C nor the rubber layer 14B has the skin layer portions and the protrusions as shown in a second B-B'. The resistance value of the rubber layer 14B is about $^{4}$ to $^{7}$log Ω and the resistance value of the overall roll of the outermost surface layer 14C is set to be about $^{6.5}$ to $^{8.5}$log Ω.

Figure 3A:
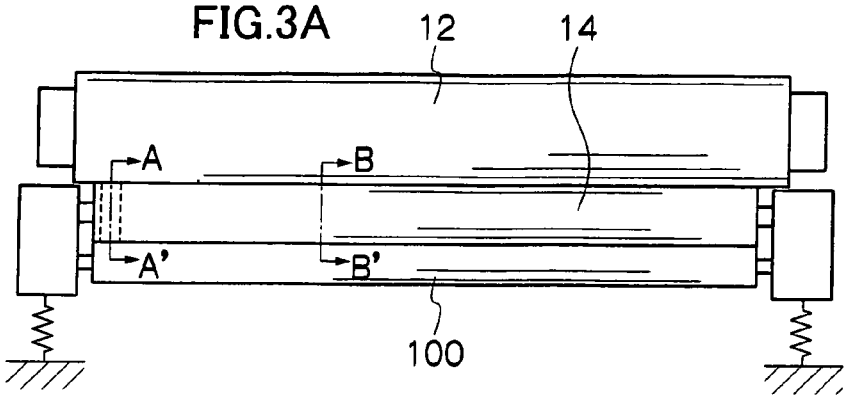
FIG. 3A is a schematic diagram showing a skin layer portion according to the first embodiment of the present invention.
Figure 3B:
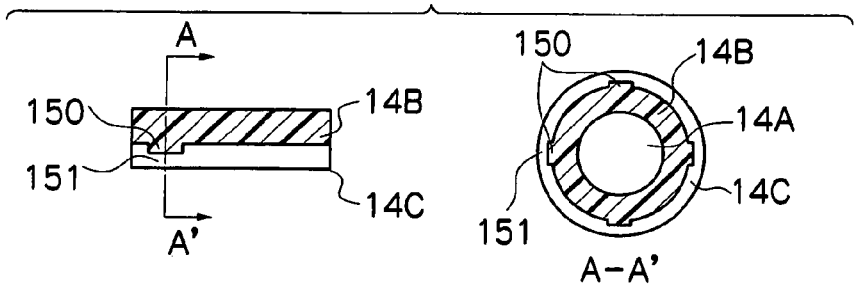
FIG. 3B is a schematic diagram showing the skin layer portion according to the first embodiment of the present invention.
Figure 3C:
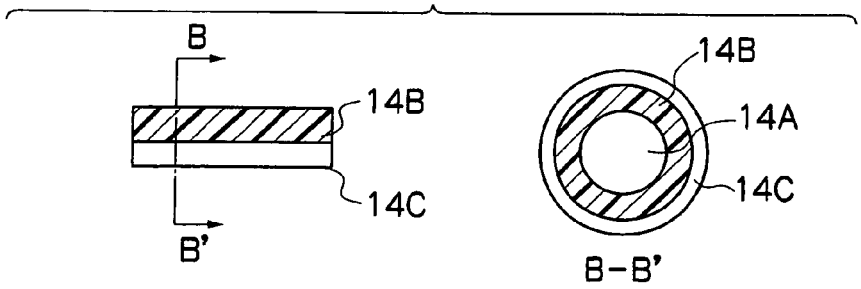
FIG. 3C is a schematic diagram showing the skin layer portion according to the first embodiment of the present invention.
Figure 3D:
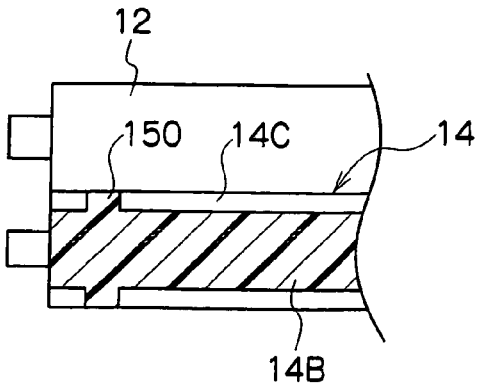
FIG. 3D is a schematic diagram showing the skin layer portion according to the first embodiment of the present invention.

The outermost surface layer 14C of the charge roll 14 is gradually scraped in the course of use due to contact with the cleaning roll 100. When wear of the outermost surface layer 14C advances and the protrusions 150 appear to the outermost surface as shown in FIG. 3D, electric current leaks due to the electrical resistance property of the rubber layer 14B and discharge does not occur at the portions. In other words, because the surface of the photosensitive drum 12 is not charged at the portions, the portions which have not been charged are developed with the toner due to the potential difference when the portions pass through the developing device 18 (see FIG. 1). Therefore, at these portions, toner patches are formed at constant intervals.

In this case, because the skin layer portions 151 are formed in a developable area and outside an image forming area in the axial direction, the toner patches do not appear on an actual print. In other words, if a detecting unit 152 (see FIG. 1) formed of an optical sensor or the like detects the toner patches formed outside the image forming area on the photosensitive body due to the appearance of the protrusions 150 to the outermost surface, it is possible to warn a user that the charge roll 14 or a marking unit including the charge roll is approaching the end of its life.

Resistance value, material, and size of the rubber layer 14B may be set freely in such a range that the electric current leaks only in vicinities of the protrusions 150 when the protrusions 150 appear to the outermost surface. In the present invention, an AC voltage of 0.7 k to 2.7 kVpp is superimposed on a DC voltage of −500 to −900V as a voltage applied to the charge roll 14 and the resistance value suitable to the voltage is in a range of $^{4}$ to $^{6}$log Ω. The thickness of the skin layer portions 151 depends on at which degree of wearing of the outermost surface layer 14C the warning is issued. Therefore, the thickness may be set properly to suit the thickness of the outermost surface layer 14C of the charge roll 14 to be used and the convenience of the system. The film thickness of the outermost surface layer 14C of the charge roll 14 used in the present invention is 3 to 20 μm and thicknesses of the protrusions 150 are set to be 2 to 19 μm.

Next, as an example of the present invention, a result of a wear evaluation of the charge roll carried out based on the above first embodiment will be described.

In the example, based on the structures shown in FIGS. 3A to 3D, the following charge roll is used. A rubber layer formed by uniformly dispersing acetylene black into isoprene rubber of a thickness of 2 mm is stacked on a metal shaft of ϕ8, and an outermost surface layer made of fluorine acrylate resin (a polymer of perfluorooctylethyl acrylate) of 10 ρm is further formed on the rubber layer. The resistance value of the rubber layer is 106.8Ω and resistance of the outermost surface layer is set such that the resistance value of the overall charge roll is 107.5Ω. At the portion in contact with the cleaning roll and outside the image forming area in the axial direction, the rubber layer 14B is provided with protrusions 150 of thicknesses of 4 μm and about 1 mm square at intervals of 90° in the circumferential direction of the charge roll, such that skin layer portions of thicknesses of 6 μm are formed as a result.

As the cleaning roll, the roll formed by forming a urethane foam layer of a thickness of 2.5 mm on a metal shaft of ϕ5 is used. The cleaning roll is rotated to follow the rotation of the charge roll while being engaged with the charge roll by 0.75 mm. The number of the cells of the cleaning roll is 55/25 mm.

The photosensitive drum 12 is formed by applying an organic photosensitive layer of 20 μm on an aluminum drum of ϕ30. An optical toner image detecting unit is provided in a position on the photosensitive drum corresponding to the skin layer portions to warn that the charge roll is approaching the end of its life when the toner image detecting unit has detected the toner images.

Figure 9A:
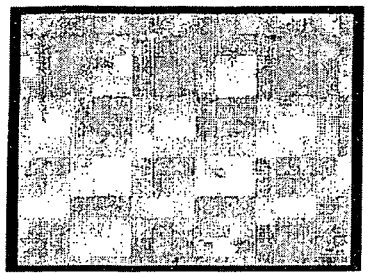
FIG. 9A is a photograph showing a condition of wearing away of a surface of the charge roll.
Figure 9B:
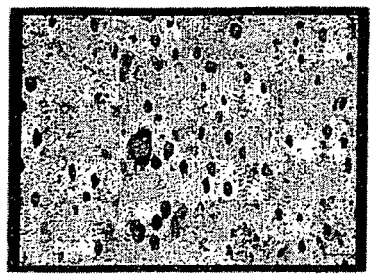
FIG. 9B is a photograph showing a condition of wearing away of the surface of the charge roll.
Figure 9C:
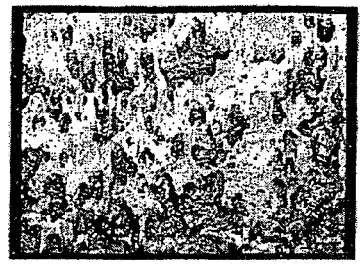
FIG. 9C is a photograph showing a condition of wearing away of the surface of the charge roll.

With this structure, a print test is conducted by using a chart with an image density of 5%. As a result, the warning is found to be issued when the number of cycles of the photosensitive body has reached 1,000,000 rotations. FIGS. 9A to 9C are photographs showing the wear conditions of the surface of the charge roll.

The thicknesses of the skin layer portions 151 are set to be 6 μm (60%) with respect to the thickness of 10 μm of the surface layer in the embodiment, and the results of cases in which the thicknesses of the skin layer portions are changed are shown in FIG. 10. The thicknesses of the outermost surface layers are 10 μm and 20 μm and the thicknesses of the skin layer portions are changed properly. In such cases, it is found that a difference in thickness between the skin layer portions and the periphery affects a charging potential from an initial stage such that a toner band is formed and the wear can not be detected accurately when the thickness of the skin layer portions was smaller than 50%. Moreover, it is found that the peripheral rubber layer becomes exposed prior to the appearance of the protrusions of the rubber layer due to wearing such that a defect in an image quality due to defective charging is caused when the thickness of the skin layer portions exceeds 90%. This is caused by variations in the amount of wearing away of the surface of the charge roll, and as a result, it is found that the thickness of the skin layer portions is preferably 50% to 90% of the outermost surface layer.

Figure 4A:
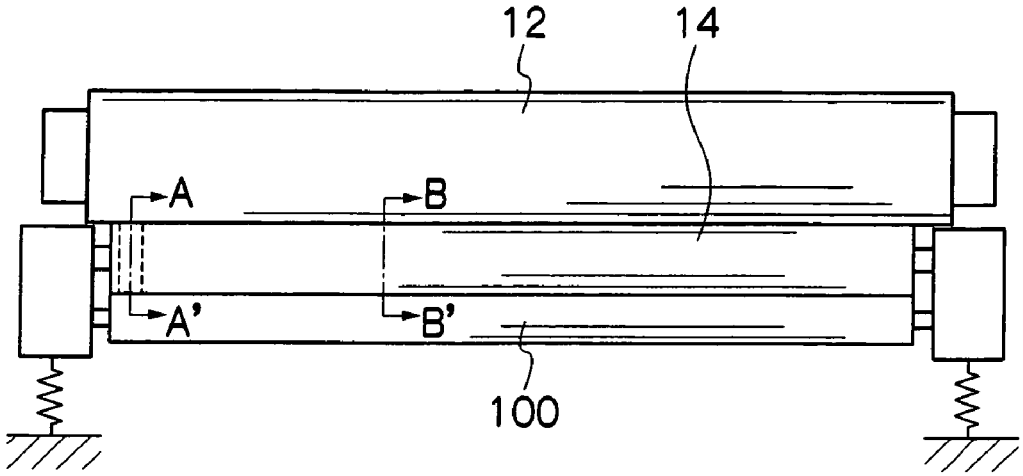
FIG. 4A is a schematic diagram showing a skin layer portion according to a second embodiment of the present invention.
Figure 4B:
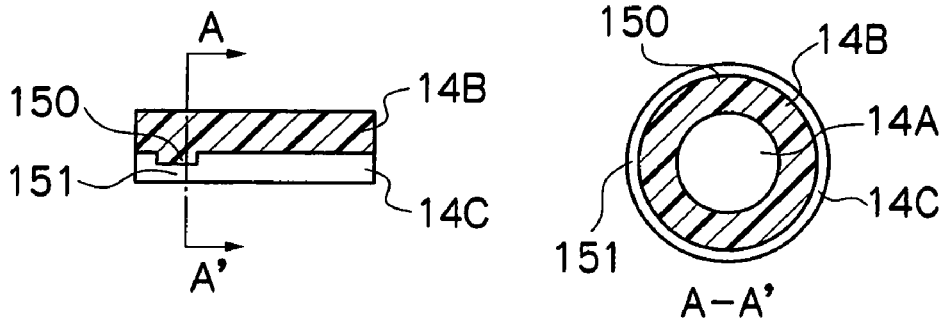
FIG. 4B is a schematic diagram showing the skin layer portion according to the second embodiment of the present invention.
Figure 4C:
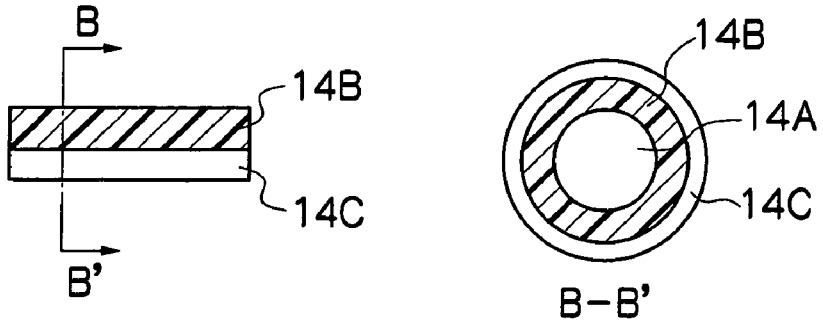
FIG. 4C is a schematic diagram showing the skin layer portion according to the second embodiment of the present invention.

Next, a second embodiment of the present invention is shown in FIGS. 4A to 4C.

In the present embodiment, as shown in a section A-A', the protrusion 150 is formed throughout the circumferential direction of the skin layer portion 151 and the section A-A' is different from a section B-B' of other portions in an outside diameter of the rubber layer 14B. In this case, the skin layer portion 151 of the charge roll 14 is gradually scraped due to contact with the cleaning roll 100. When the protrusion 150 of the rubber layer 14B appears throughout the circumferential direction, the electric current leaks from this portion and the discharge does not occur. In this case, due to the above-described potential relationship, a continuous toner band is formed on the photosensitive body and it is possible to warn a user that the charge roll 14 or the marking unit including the charge roll is approaching the end of its life.

Figure 5A:
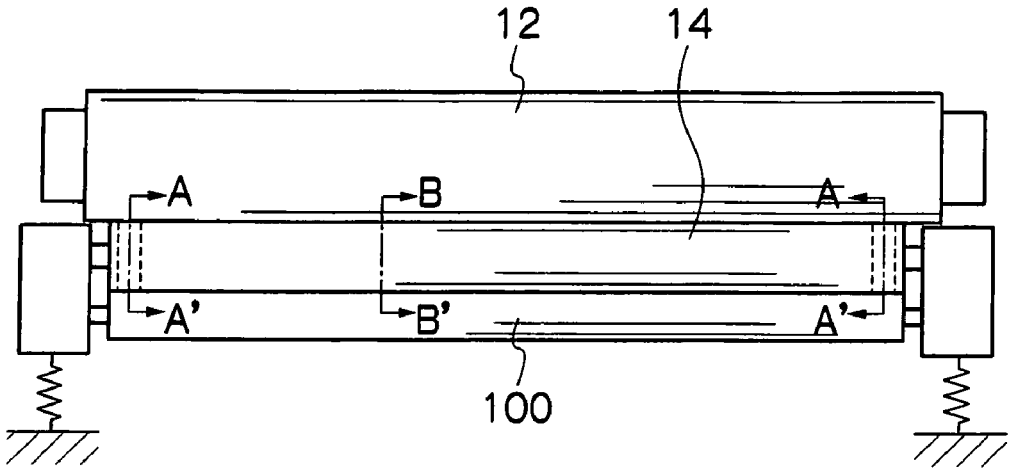
FIG. 5A is a schematic diagram showing a skin layer portion according to a third embodiment of the present invention.
Figure 5B:
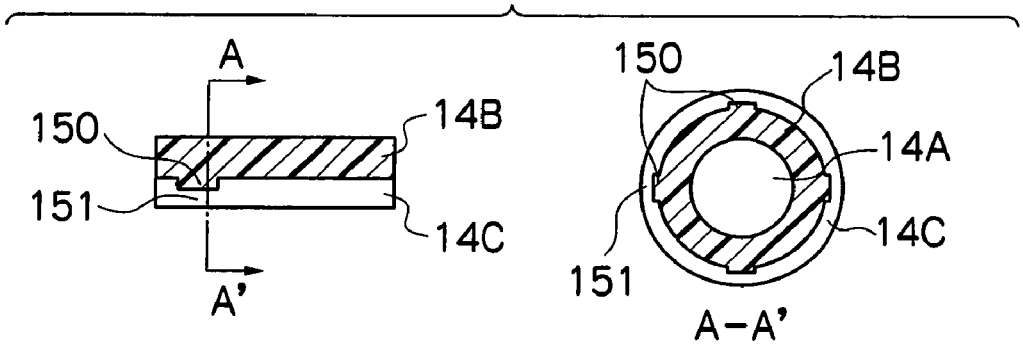
FIG. 5B is a schematic diagram showing the skin layer portion according to the third embodiment of the present invention.
Figure 5C:
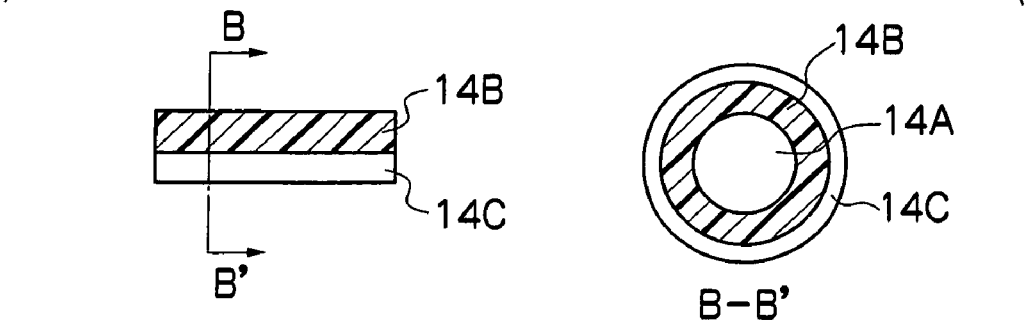
FIG. 5C is a schematic diagram showing the skin layer portion according to the third embodiment of the present invention.

Next, a third embodiment of the present invention is shown in FIGS. 5A to 5C.

In the present embodiment, the skin layer portions 151 of the first and second embodiments are formed on opposite sides of the charge roll. Moreover, the rubber layer 14B is ground such that it has higher surface roughness than the outermost surface layer 14C. The foreign matters and depositions adhere to the surfaces of the charge roll and the cleaning roll in the course of use of the apparatus over a long term, such that a rotation transmitting force between the members is reduced and the defective charging is generated. However, the surface roughness of the protrusions 150 exposed due to wearing increases the rotation transmitting force between the charge roll, the photosensitive body, and the cleaning roll, such that an effect of suppressing the above problems is produced. Moreover, because rotating properties are not impaired, the above-described toner patches and band can be detected reliably by the downstream detecting unit so as to enhance the effect of the present invention.

An example based on the third embodiment will be shown below. Here, the rubber layer 14B made of urethane rubber is ground to have surface roughness of Rz 2.5 to 5.0 μm and the outermost surface layer 14C made of fluorine acrylate resin is ground to have surface roughness of Rz 1.0 to 2.0 μm.

Their surface roughnesses are measured in the circumferential direction of the charge roll by using Surfcom-590A manufactured by TOKYO SEIMITSU CO., LTD., with a pickup stylus E-DT-SO1A, on a setting of JIS'82, and under measuring conditions of:

a measuring length of 4 mm;

a measuring speed of 0.3 mm/s;

a cut-off length of 0.8 mm; and a cut-off type of 2CR (phase compensation).

Under the same conditions of other structures as the first example, an evaluation is made. As a result of a print test by using a chart with an image density of 5%, it is found that the above warning is issued similarly when the number of cycles of the photosensitive body has reached 1,000,000 rotations.

Figure 11A:
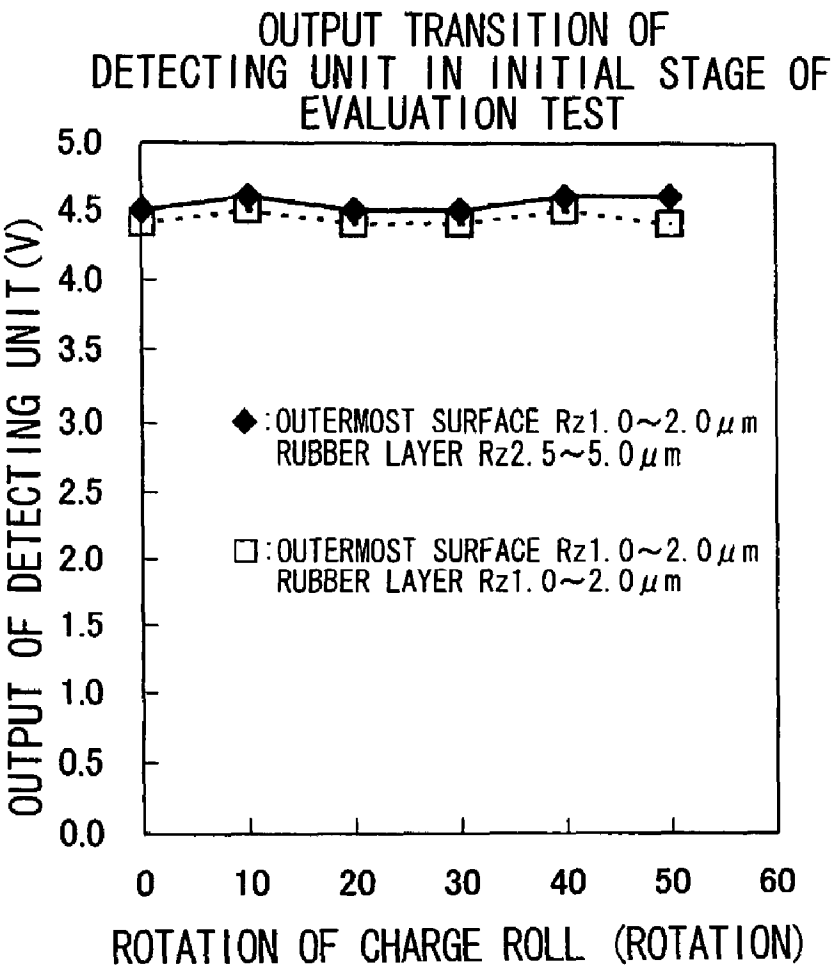
FIG. 11 A is a graph showing examination of fluctuations in output voltage during the life detection according to the difference in surface roughness of a rubber layer and the outermost surface layer.
Figure 11B:
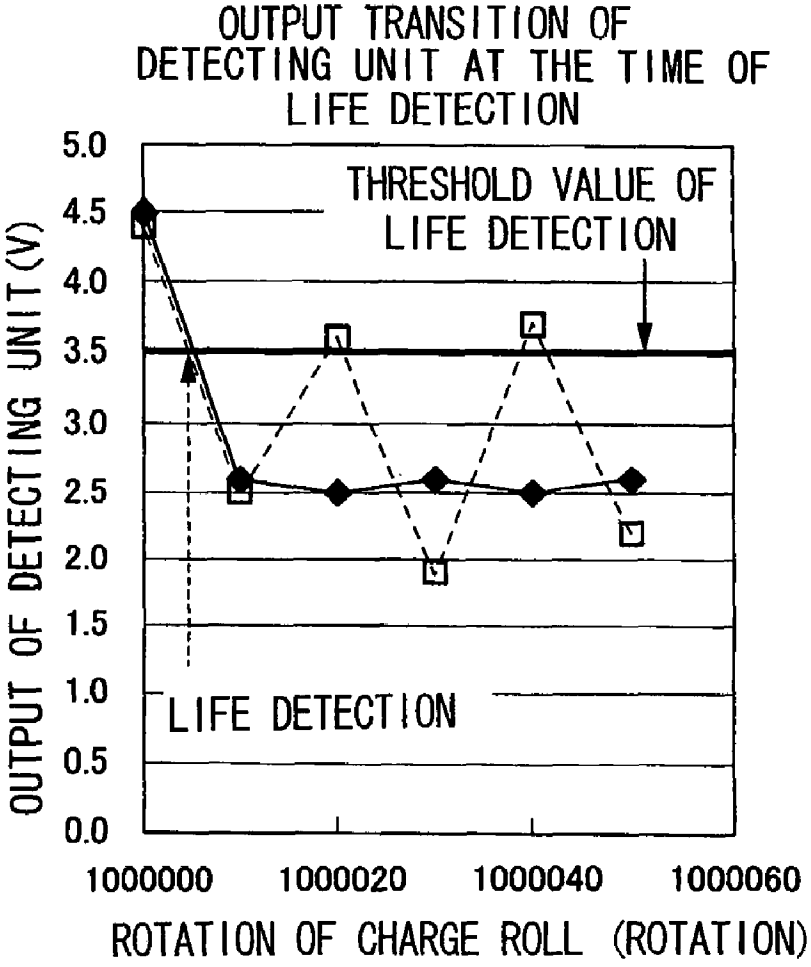

Here, in order to verify an effect of the difference in the surface roughness, as shown in FIGS. 11A to 11B, an output voltage of the detecting unit at the time of life detection when the surface roughness of the rubber layer is changed by grinding is examined. As compared with a case where the surface roughness of the rubber layer 14B is Rz 1.0 to 2.0 μm which is the same as that of the outermost surface layer 14C, it can be understood that the detection of the toner band by the detecting unit after life detection is stable. This is because the roughness of the exposed rubber layer surface prevents the slippage of rotation of the charge roll due to the foreign matters that have adhered to the surfaces of the charge roll and the cleaning roll to thereby prevent density of the toner patches from becoming unstable. Therefore, by setting the surface roughness of the exposed protrusions (rubber layer) higher than that of the outermost surface layer, a bad rotation of the charge roll is suppressed and it is possible to accurately carry out the life detection of the charge roll due to wearing.

Figure 6A:
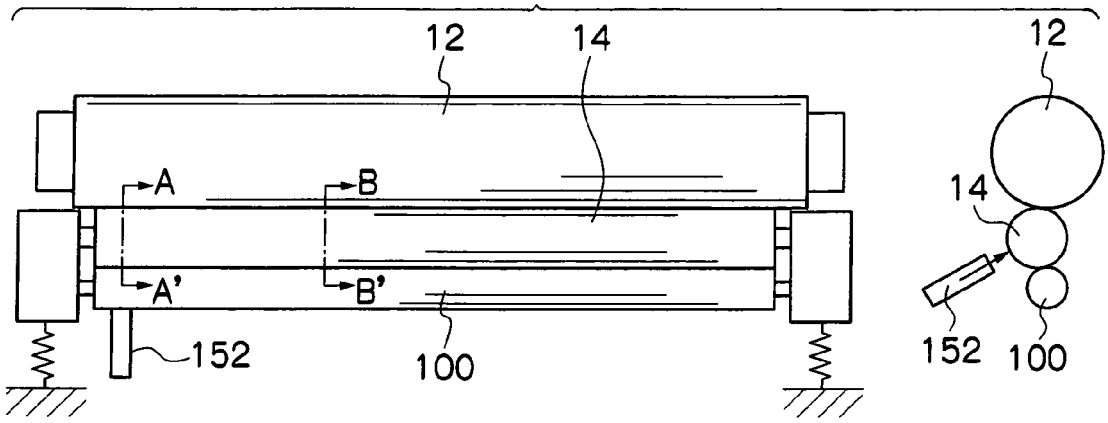
FIG. 6A is a schematic diagram showing a skin layer portion according to a fourth embodiment of the present invention.
Figure 6B:
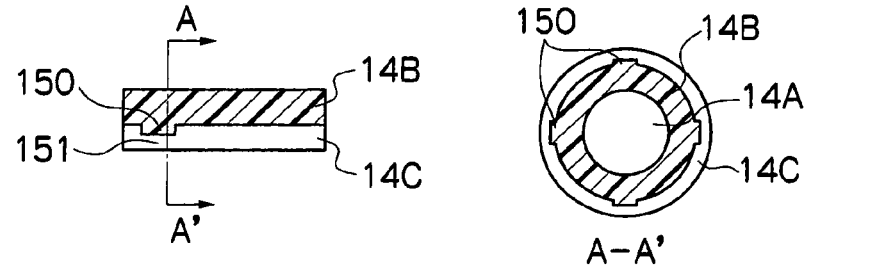
FIG. 6B is a schematic diagram showing the skin layer portion according to the fourth embodiment of the present invention.
Figure 6C:
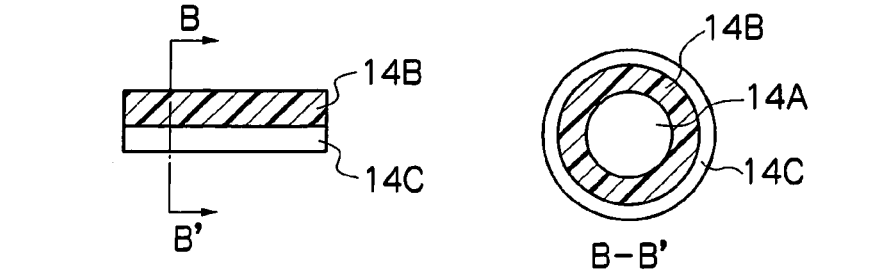
FIG. 6C is a schematic diagram showing the skin layer portion according to the fourth embodiment of the present invention.

Next, a fourth embodiment of the present invention is shown in FIGS. 6A to 6C. In the present embodiment, surface reflectivities of the above-described outermost surface layer 14C and the rubber layer 14B are set with different values. In this case, the skin layer portions 151 can be set outside the developable area in the axial direction and the detecting unit 152 formed of an optical sensor or the like and disposed in a vicinity of the skin layer portions 151 of the charge roll 14 can detect the change in the surface reflectivities of the outermost surface layer 14C that wears away and the exposed protrusions 150 of the rubber layer 14B, such that the life of the charge roll can be similarly determined.

Here, an example based on the fourth embodiment will be described. In the present example, a KUA0036B sensor manufactured by STANLEY ELECTRIC CO., LTD. is disposed at a distance of about 3 mm apart from the surface of the charge roll. Here, the results of the life detection when the charge roll has rotated about 1,000,000 times and the surface reflectivities of the outermost surface layer and the rubber layer are changed in a range of 20% to 80%, are shown in FIG. 12.

In order to change the surface reflectivities of the two layers, fluorine acrylate resin (a polymer of perfluorooctylethyl acrylate) is used as a base material of the outermost surface layer, silicon rubber is used as a base material of the rubber layer, and the outer most surface layer and the rubber layer includes acetylene black of 2% and 3.5% by weight respectively, such that the surface reflectivitities of 20% are obtained. Then, by gradually increasing the content of the acetylene black, the surface reflectivities are regulated up to 80%. The surface reflectivities are measured by using USPM-RU-1700 manufactured by OLYMPUS CORPORATION and under a condition of a measuring wavelength of 1500 nm.

As shown in FIG. 12, by setting the surface reflectivities of the two layers with different values and detecting the exposure of the protrusions by the optical sensor of an optical reflection type, it is possible to detect the life of the charge roll. Here, when the surface reflectivity of the outermost surface layer is 80% and the surface reflectivity of the rubber layer is 20%, the life can be detected most stably. The reason for this is thought to be that the rate of change is highest when the exposure changes from the outermost surface layer to the rubber layer. On the other hand, if the surface reflectivity of the outermost surface layer is 20% and the surface reflectivity of the rubber layer is 80%, it is found that there is a problem of false life detection of the charge roll as a result of the detection of the reflection property of the rubber layer by the sensor before the exposure of the protrusions.

Figure 7A:
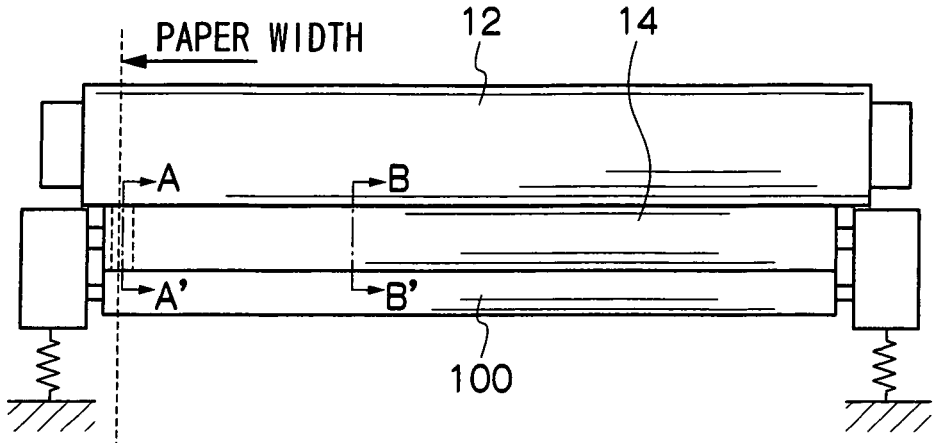
FIG. 7A is a schematic diagram showing a skin layer portion according to a fifth embodiment of the present invention.
Figure 7B:
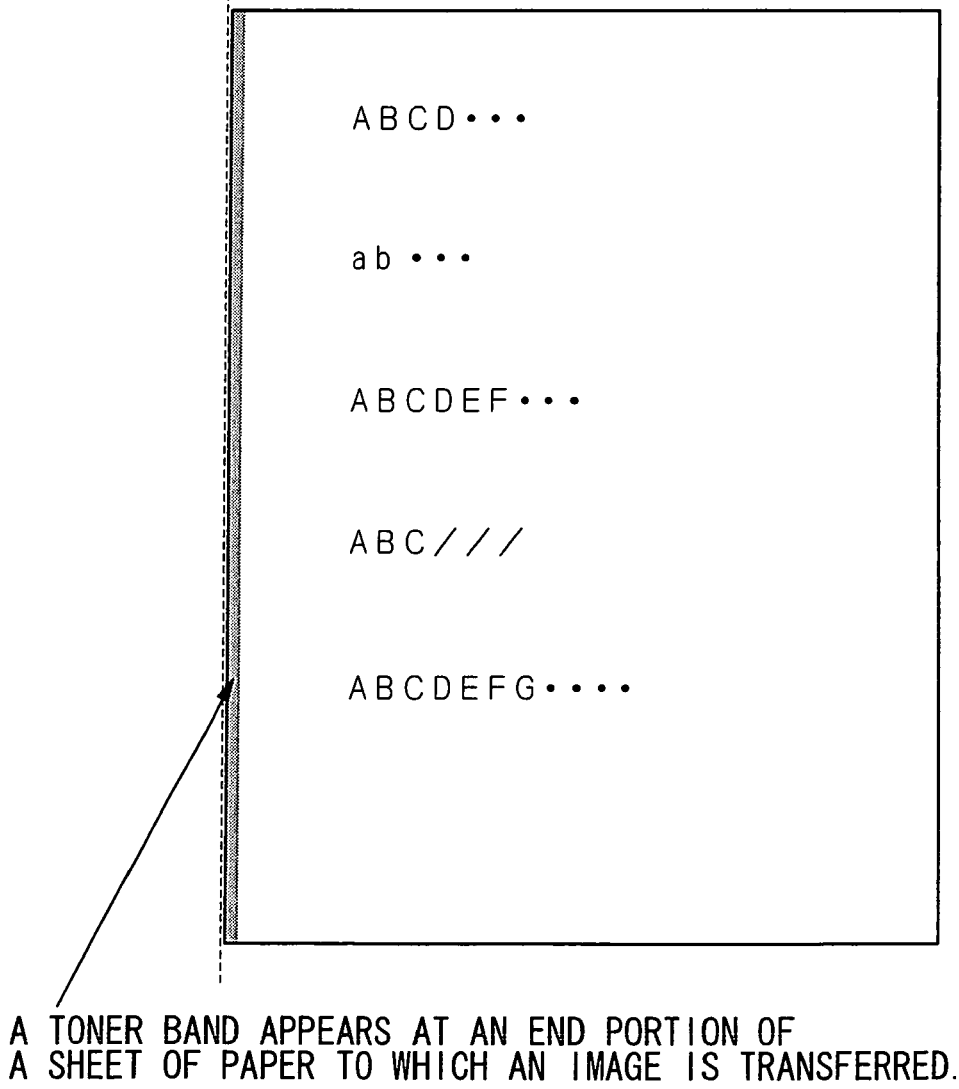
FIG. 7B is a schematic diagram showing the skin layer portion according to the fifth embodiment of the present invention.

Moreover, a fifth embodiment of the present invention is shown in FIGS. 7A to 7B. In the structure of the above-described first embodiment, the skin layer portions 151 may be disposed in the developable area and in the image forming area in the axial direction of the charge roll 14. In this case, it is preferable to dispose the skin layer portions 151 at a portion positioned at an end portion of a sheet of paper to which the image is transferred. In this case, the above-described toner patches or the toner band appear on an end portion of a print output by the user. However, by informing the user of the life early before many prints with degraded image quality are output, it becomes possible to replace the members.

Figure 8A:
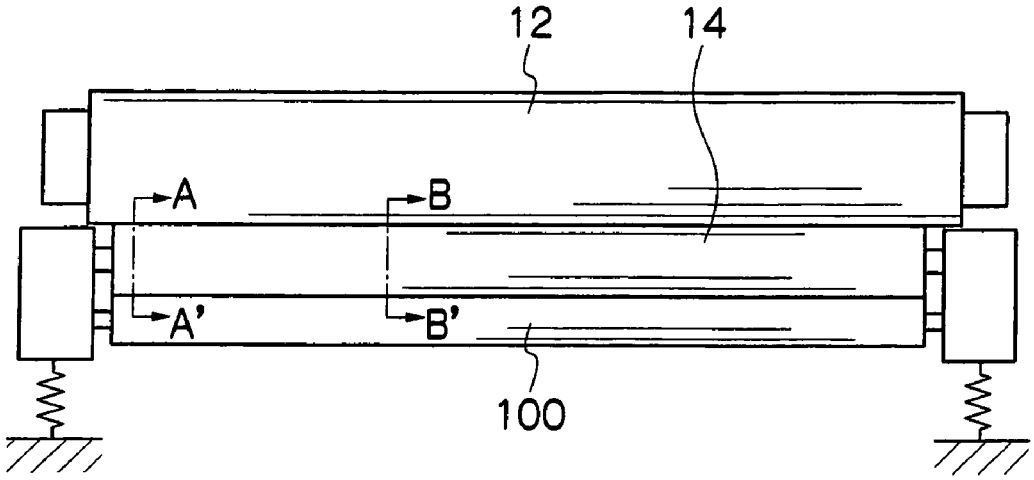
FIG. 8A is a schematic diagram showing a skin layer portion according to a sixth embodiment of the present invention.
Figure 8B:
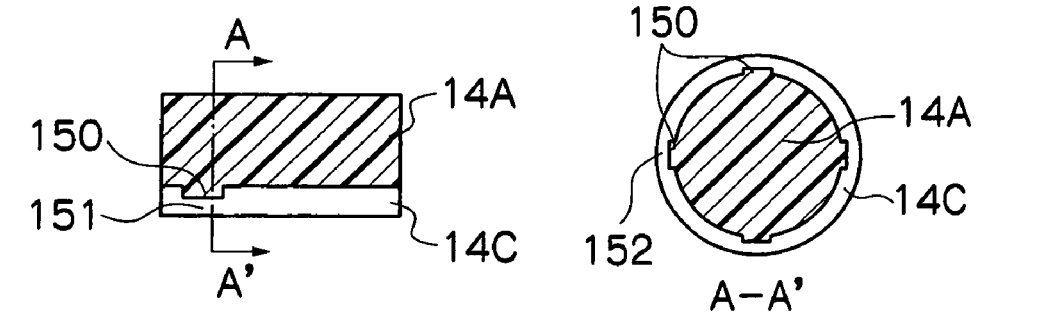
FIG. 8B is a schematic diagram showing the skin layer portion according to the sixth embodiment of the present invention.
Figure 8C:
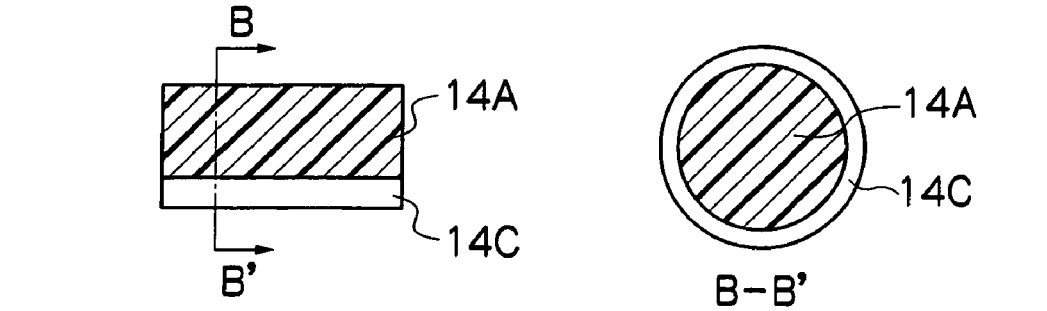
FIG. 8C is a schematic diagram showing the skin layer portion according to the sixth embodiment of the present invention.

Moreover, a sixth embodiment of the present invention is shown in FIGS. 8A to 8C. In the embodiment, the charge roll 14 does not have the rubber layer 14B and is formed of the shaft 14A and the outermost surface layer 14C only. In this case, at the skin layer portions 151, the shaft 14A has the protrusions 150, the protrusions 150 are exposed due to wearing away of the outermost surface layer 14C, the toner patches or toner band are formed with the same action as that described above, and it is possible to detect the end of life of the charge roll 14.

As described above, in the image forming apparatus 10 of the embodiments, the surface of the charge roll wears away due to the contact between the charge roll and the cleaning member and it is possible to accurately ascertain the life of the charge roll which eventually causes the problem such as the defective charging. Therefore, it is possible to urge the user to replace the charge roll at a proper time without allowing the user to output many prints with degraded image quality.

The charge roll 14 and the cleaning roll 100 of the present invention are not limited to the above materials and structures. Although the cleaning roll 100 is pressed under a predetermined load against the charge roll 14 and the sponge layer 100B is elastically deformed along the peripheral surface of the charge roll 14 to form the nip portion 11 in the above embodiments, it is also possible that the cleaning roll has a structure coming into contact with the charge roll under its own weight or a structure driven in rotation. Moreover, the charge roll and the photosensitive body may carry out contact type charging or discharge charging across a minute gap. The materials and structures may be set properly as long as the cleaning member can minutely scrape the surface of the charge roll.

The detecting unit 152 may detect the toner image on the photosensitive drum 12. The detecting unit is not limited to the detecting unit 152. For example, if a constant current control to a bias applied to the charge roll 14 is employed, a voltage is not applied to the portions where the protrusions 150 have appeared and therefore it is possible to detect this state. If a constant voltage control is employed, it is possible to detect that the electrical current becomes abnormally large.

Although the charge roll 14 is in contact with the lower portion of the photosensitive drum 12 and the cleaning roll 100 is in contact with the lower portion of the charge roll 14 in the configuration of the respective members in the embodiments, they are not limited to such a configuration. For example, the present invention can also be applied to a configuration where the charge roll is in contact with an upper portion of the photosensitive drum and the cleaning roll is in contact with an upper portion of the charge roll.

Moreover, four cycles for the forming of the toner image on the photosensitive drum 12 are repeated by using the rotary developing device 18 in the image forming apparatus 10 of the embodiments, the apparatus is not limited to this structure. For example, the present invention can be applied to the photosensitive drum, the charge roll and the roll-shaped cleaning roll of each image forming unit in a structure in which image forming units of yellow, magenta, cyan, and black are arranged side by side in a moving direction of the intermediate transfer belt. In this case, the present invention may be applied to each color to individually detect wearing away of the charge rolls.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charge roll disposed in an image forming apparatus, for charging an image carrier for carrying an image, and to be cleaned by a cleaning member, the charge roll comprising:

a shaft and an electrically conductive layer provided around the shaft, and having different physical properties from the shaft, an axial end portion of the electrically conductive layer in an area in contact with the cleaning member being formed into skin layer portions thinner than other portions of the electrically conductive layer;

further comprising:

a detector that detects exposure of the shaft due to scraping of the skin layer portions by the contact with the cleaning member; and a warning unit that reports that the life of the charge roll has expired based on a detection result from the detector.

2. The charge roll of claim 1, wherein the electrically conductive layer is formed of a first conductive layer provided around the shaft and a second conductive layer provided around the first conductive layer and having different physical properties from the first conductive layer, protrusions are formed on the first conductive layer, and the skin layer portions are formed at an axial end portion of the second conductive layer.

3. The charge roll of claim 1, wherein the different physical properties comprise electrical resistance values of the shaft being lower than those of the electrically conductive layer.

4. The charge roll of claim 2, wherein the different physical properties comprise electrical resistance values of the shaft or the first conductive layer being lower than those of the electrically conductive layer or the second conductive layer.

5. The charge roll of claim 1, wherein the different physical properties comprise surface reflectivity of the shaft being different from that of the electrically conductive layer.

6. The charge roll of claim 2, wherein the different physical properties comprise surface reflectivity of the shaft or the first conductive layer being different from that of the electrically conductive layer or the second conductive layer.

7. The charge roll of claim 1, wherein the skin layer portions are positioned outside an image forming area of the image carrier and in a toner developing area.

8. The charge roll of claim 1, wherein the skin layer portions are positioned juxtaposed to an image forming area of the image carrier.

9. The charge roll of claim 2, wherein the protrusions are formed at constant intervals on a peripheral surface of the shaft or the first conductive layer.

10. The charge roll of claim 2, wherein the protrusions are formed continuously along a peripheral surface of the shaft or the first conductive layer.

11. The charge roll of claim 1, wherein surface roughness of the shaft is greater than that of the electrically conductive layer.

12. The charge roll of claim 2, wherein surface roughness of the shaft or the first conductive layer is greater than that of the electrically conductive layer or the second conductive layer.

13. The charge roll of claim 1, wherein a thickness of the skin layer portions is in a range of 50% to 90% of a thickness of the electrically conductive layer or the second conductive layer.

14. The charge roll of claim 2, wherein a thickness of the skin layer portions is in a range of 50% to 90% of a thickness of the electrically conductive layer or the second conductive layer.

15. A charge roll disposed in an image forming apparatus, for charging an image carrier for carrying an image, and to be cleaned by a cleaning member, the charge roll comprising:

a shaft and an electrically conductive layer provided around the shaft, an axial end portion of the electrically conductive layer in an area in contact with the cleaning member being formed into skin layer portions thinner than other portions of the electrically conductive layer, wherein the electrically conductive layer is formed of a first conductive layer provided around the shaft and a second conductive layer provided around the first conductive layer and having different physical properties from the first conductive layer, protrusions are formed on the first conductive layer, and the skin layer portions are formed at an axial end portion of the second conductive layer;

further comprising:

a detector that detects exposure of the shaft or the first conductive layer due to scraping of the skin layer portions by the contact with the cleaning member; and a warning unit that reports that the life of the charge roll has expired based on a detection result from the detecting unit.

* * * * *